United States Patent [19]

Davis

[11] Patent Number: 4,867,184

[45] Date of Patent: Sep. 19, 1989

[54] METHOD OF CUTTING HAIR AND TOOTHED TEMPLATE CURVES FOR CUTTING HAIR

[76] Inventor: Donald D. Davis, 3234 Hill St., San Diego, Calif. 92106

[21] Appl. No.: 90,232

[22] Filed: Aug. 27, 1987

[51] Int. Cl.[4] ..... A45D 24/36

[52] U.S. Cl. ..... 132/214; 132/150

[58] Field of Search ..... 132/45 R, 45 A, 213, 132/214, 107, 126, 150

[56] References Cited

U.S. PATENT DOCUMENTS

| | | | |
|---|---|---|---|
| 159,004 | 1/1875 | Wilkins | 132/45 R |
| 567,910 | 9/1896 | Mathews | 132/45 R |
| 938,040 | 10/1909 | Caldwell | 132/45 R |
| 1,108,224 | 8/1914 | Perlin | 132/45 R |
| 2,166,558 | 7/1939 | Quinio | 132/150 |
| 2,949,920 | 8/1960 | Humphrey | 132/45 R |
| 3,277,902 | 10/1966 | Korst | 132/45 R |
| 3,382,877 | 5/1968 | Cercone | 132/45 R |
| 4,381,015 | 4/1983 | Harvath | 132/45 R |
| 4,414,991 | 11/1983 | Marcotte | 132/214 |

FOREIGN PATENT DOCUMENTS

| | | | |
|---|---|---|---|
| 2500729 | 9/1982 | France | 224/163 |

*Primary Examiner*—John J. Wilson
*Assistant Examiner*—Adriene J. Lepiane
*Attorney, Agent, or Firm*—Duane C. Bowen

[57] ABSTRACT

Method and apparatus for cutting hair of a person with a toothed curve about nine inches long which becomes a template at fixed locations during hair cutting determining the length and shape of the cut and using an electric clipper to make all of the cuts using the curve back as a guide, the curve having a simple curvature arced relative to a centrally located axis parallel to and spaced from the axes of the teeth of the curve. Cutting on the concave or the convex face of the curve. Supplying a plurality of curves arced on different radiuses, the curves with lesser radiuses removing more weight of hair than curves with larger radiuses. Providing a variable speed control for the clipper and providing blades with more or less teeth per inch to provide in operations like feathering a blade with less teeth per inch driven at a lower speed. Adjacent tooth surfaces on the curve being roughened to grip hair. The backing portion of the curve having a first pair of guiding surfaces on opposite sides to space the clipper blade from the teeth and having a second pair of guiding surfaces perpendicular to the first surfaces, at the opposite side of the backing portion from the teeth, to guide the clipper blade from end to end of the curve. A handle for the curve on the opposite side of the backing portion from the teeth attachable at either end of the curve or in the middle.

28 Claims, 5 Drawing Sheets

Fig 1
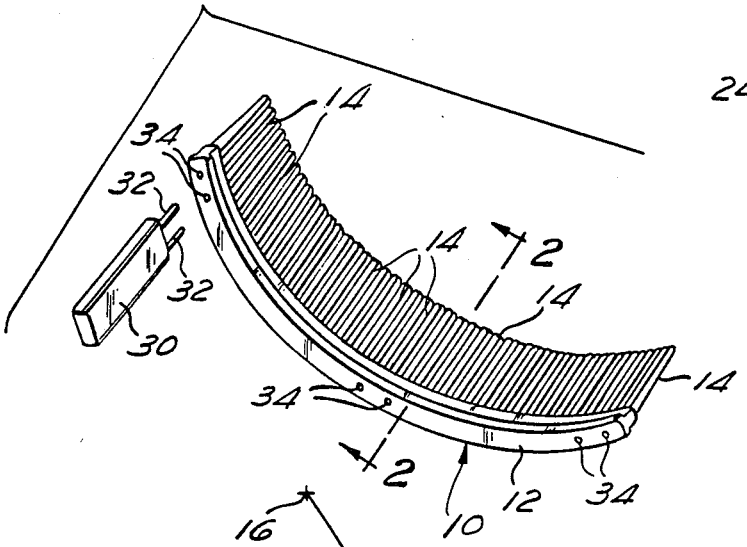
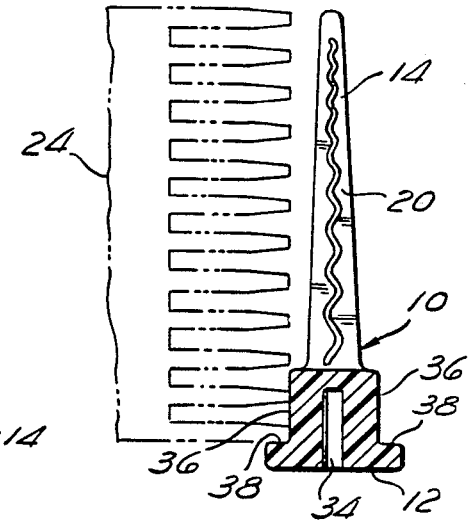
Fig. 2
Fig. 3a
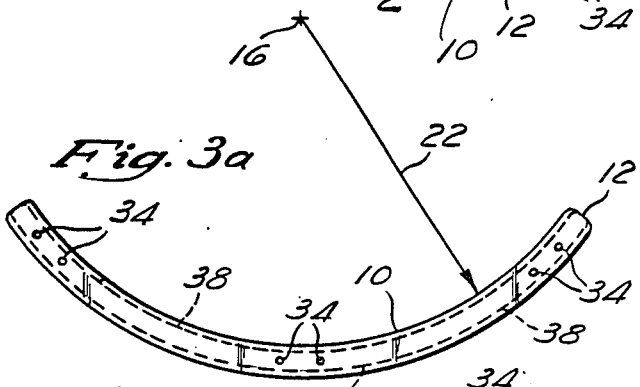
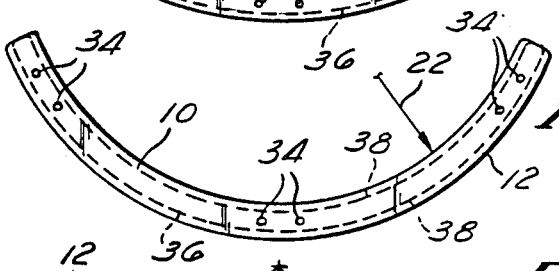
Fig. 3b
Fig. 3c
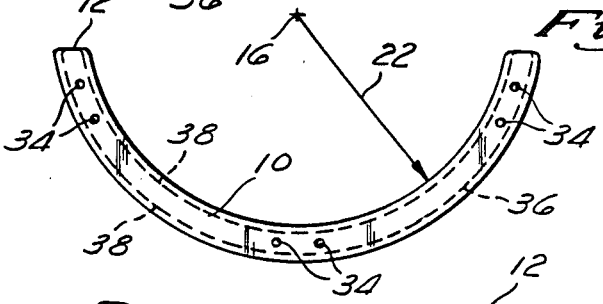
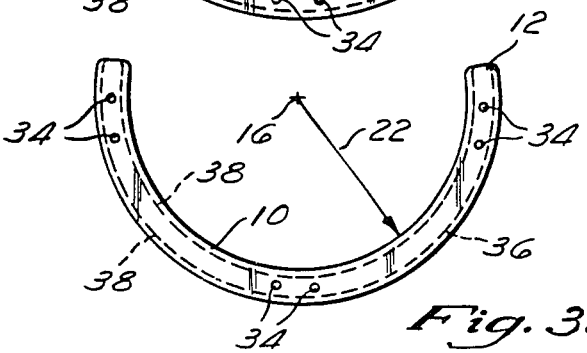
Fig. 3d
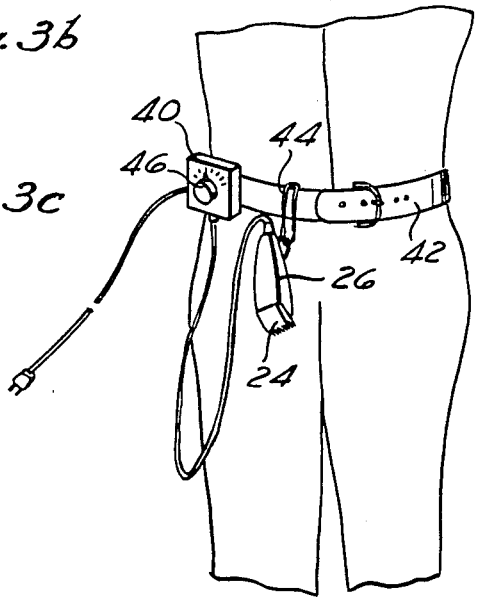
Fig. 4

Fig. 5
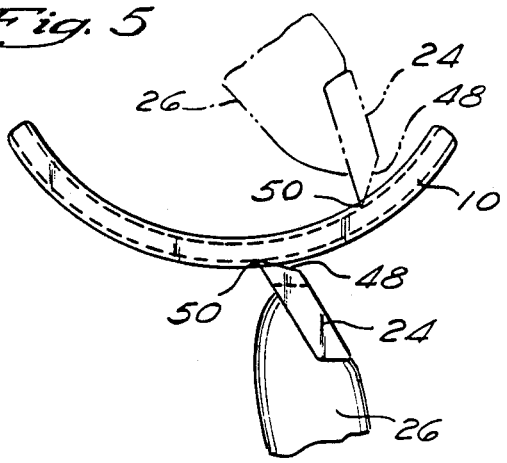
Fig. 6
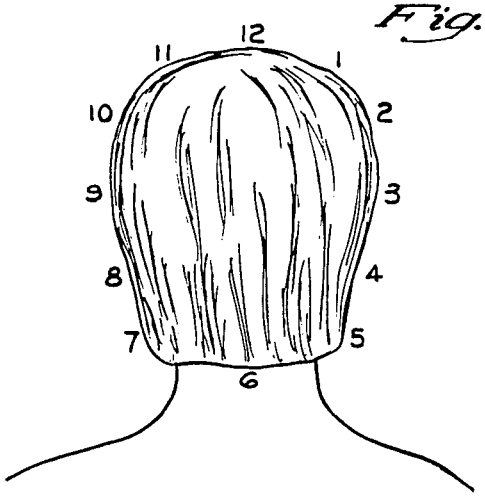
Fig. 7a
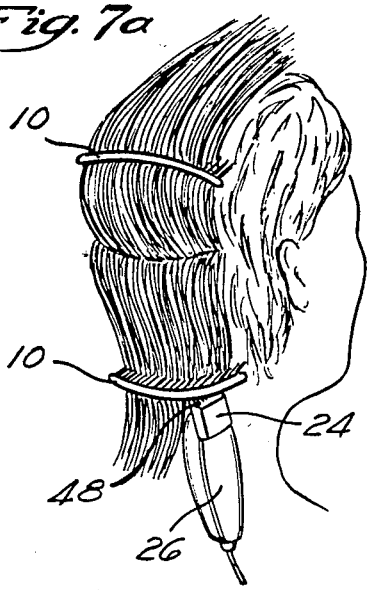
Fig. 7b
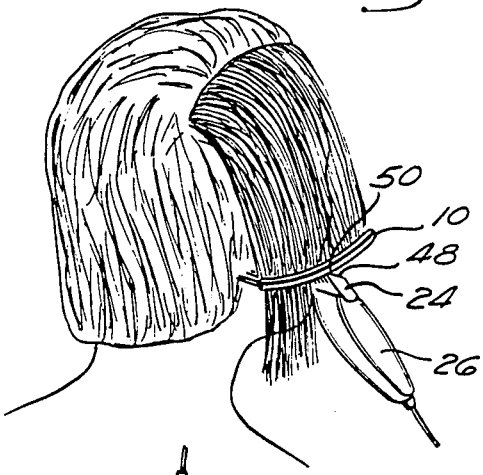
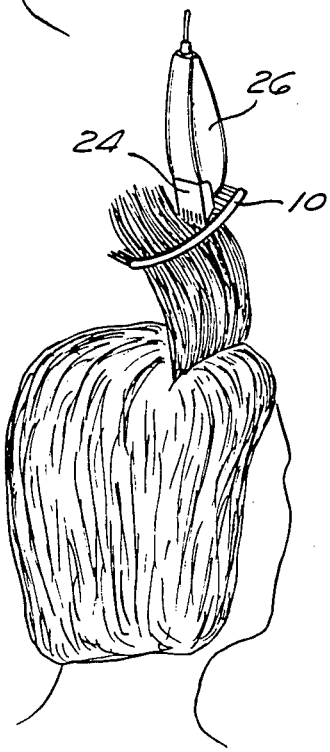
Fig. 7c
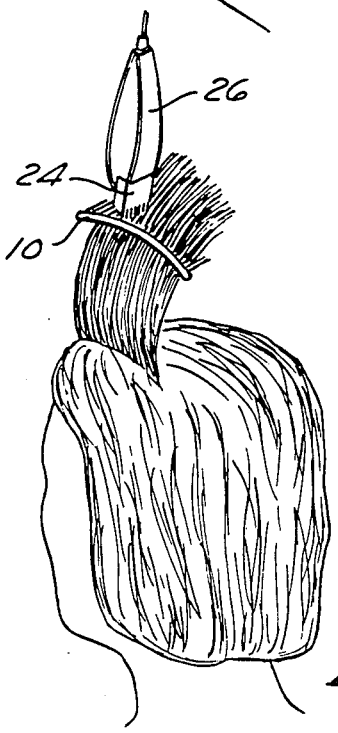
Fig. 7d Fig. 8
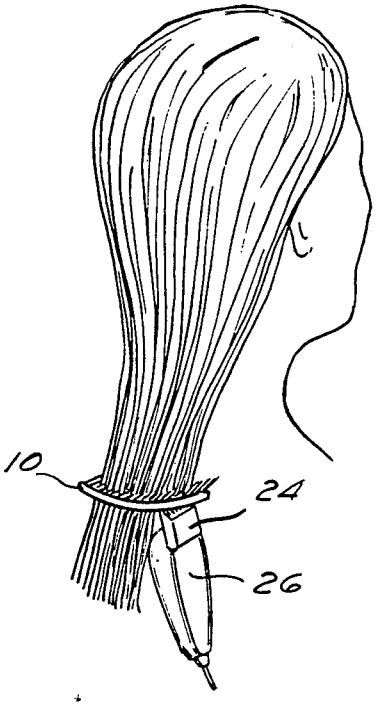
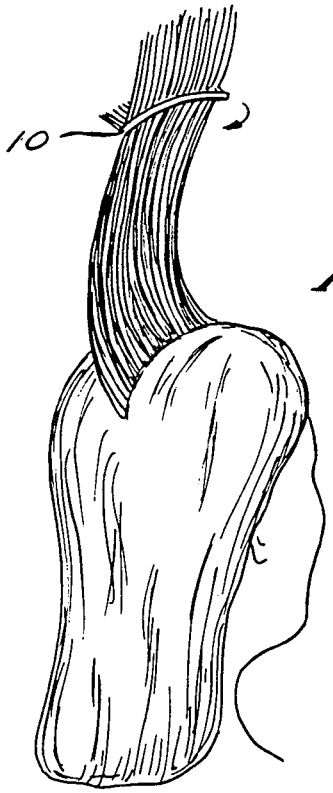
Fig. 9a
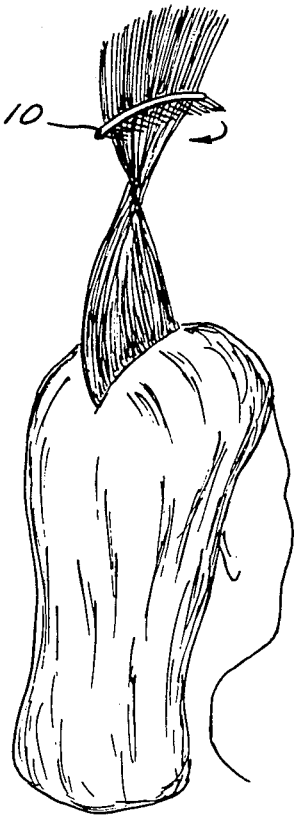
Fig. 9b
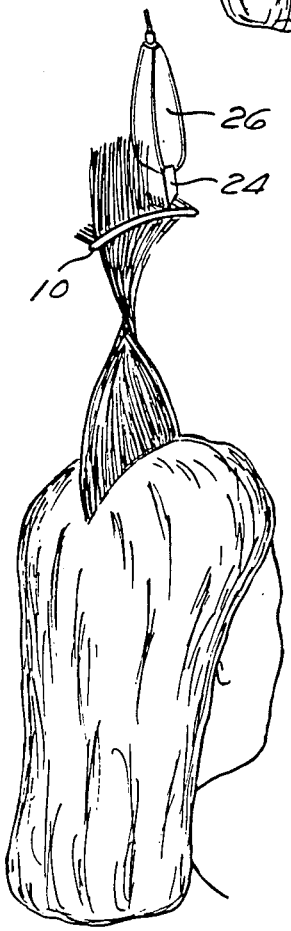
Fig. 9c Fig. 10
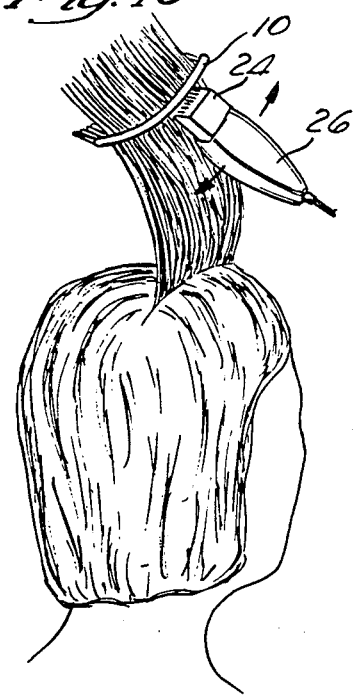
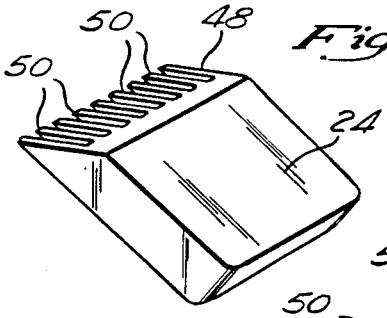
Fig. 11a
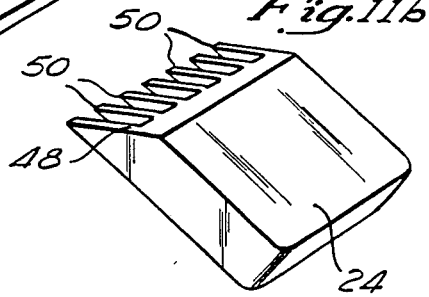
Fig. 11b
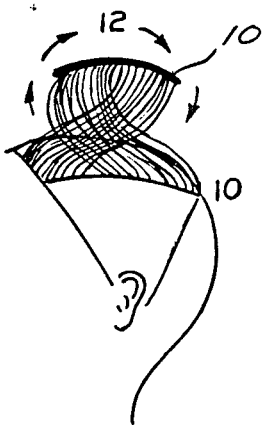
Fig. 12a
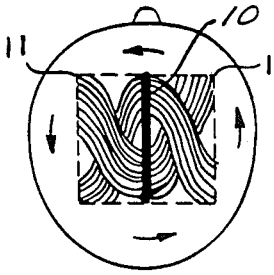
Fig. 12b
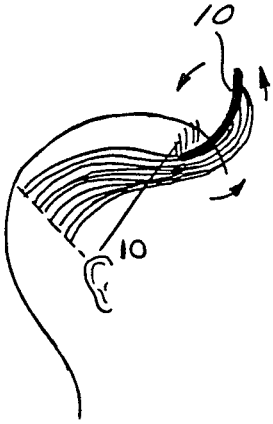
Fig. 12c
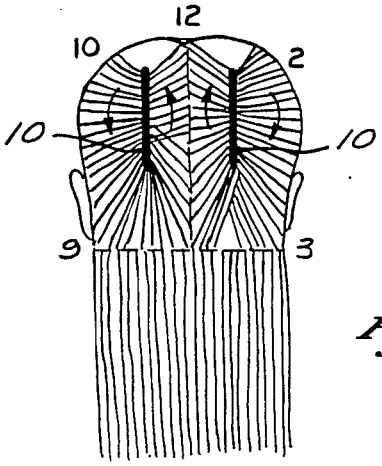
Fig. 12d Fig. 13b
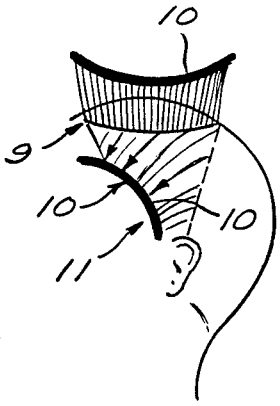
Fig. 13a
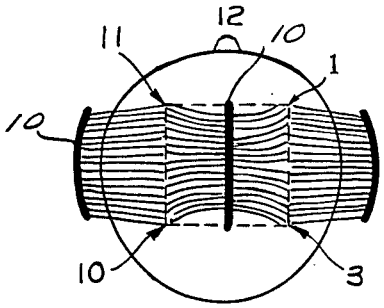
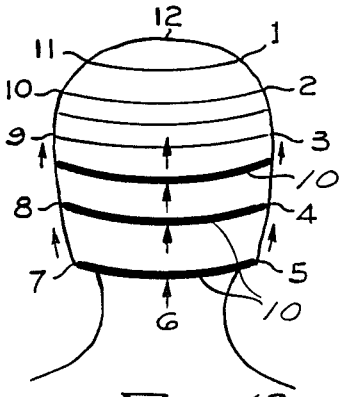
Fig. 13c
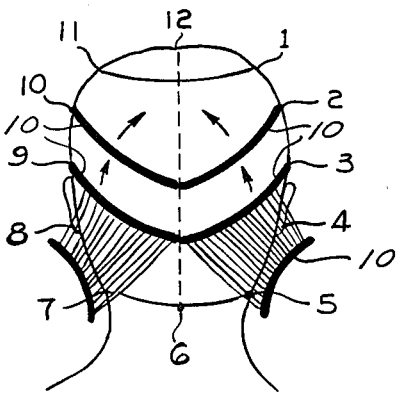
Fig. 13d
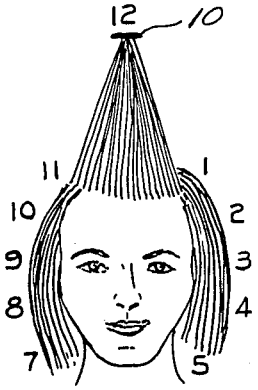
Fig. 14a
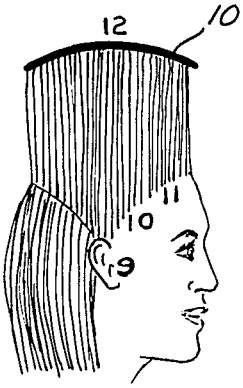
Fig. 14b
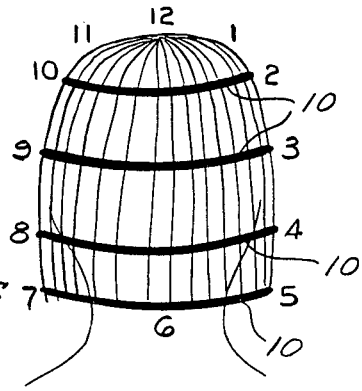
Fig. 14c
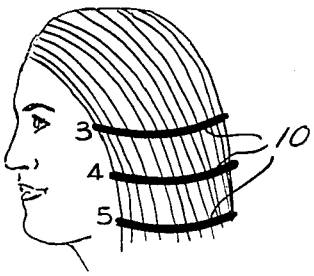
Fig. 14d

METHOD OF CUTTING HAIR AND TOOTHED TEMPLATE CURVES FOR CUTTING HAIR

BRIEF SUMMARY OF THE INVENTION, BACKGROUND AND OBJECTIVES

My invention concerns a new method of cutting hair and special toothed template curves that are utilized in that method.

In the 1960's, newer haircutting techniques included razor cutting, wet sets (sitting under a dryer), and shaping by back combing (teasing). The 1970's brought about a major revolution in technique. Vidal Sassoon re-evaluated the art of hair design and created the process of precision geometric cutting with shears. The results included freedom from static forms, free flowing hair, and capability of making creative designs. Hair tended to be more healthy and shining. The drying of hair was more natural. New terms evolved such as "elevation", "overdirection", and "finger angle".

I have developed a new method which I believe is a marked improvement over the innovations of the 1970's described above in the following respects, among others: Hair cutting is done with electric clippers to the exclusion of shears. I provide a variable speed control for the clippers and use several types of blades including blade sizes not previously used on human hair. The hair cutting method involves special toothed template curves and a straight comb is excluded. Hair preferably is treated with a sculpting foam (a mousse preparation). The method may be said to involve relatively long geodesic lines and cuts as contrasted to the prior geometric cutting which involved relatively short straight lines and cuts. The hair designer is given the freedom of a larger format. The designer should think in terms of volume, mass, and weight distribution. For the first time one can sculpt the hair either wet or dry and change shapes easily, like a sculptor working in clay. The hair designer truly becomes the master of the medium in which he or she works. Results for the hair designer include freedom of movement in a large format and softer hair designs. The designer can think more in terms of concave shapes, convex shapes, lift, and weight fall.

It is an object of my invention to develop a new geodesic method of designing and cutting hair and to achieve the characteristics, features and advantages above outlined.

It is a further object to design toothed template curves especially adapted for use in this new method of cutting hair including such features as: around nine inch lengths bent as simple curves but on different radiuses; parallel, evenly spaced, even length teeth from end to end; roughened surfaces on portions of teeth facing each other to tend to grip hair; guiding surfaces on the curves so that clippers will tend not to strike teeth and will follow the lines of the backs of the curves; and detachable handles on the curves for supporting each curve from either end or from the middle.

My invention will be best understood, together with additional advantages and objectives thereof, when read with reference to the drawings.

DRAWINGS

FIG. 1 is a perspective view of a specific embodiment of my new toothed template curve. A handle is shown in removed position.

FIG. 2 is an enlarged sectional view taken on line 2—2 of FIG. 1. The blade of an electric clipper is indicated in dashed lines.

FIGS. 3(*a*), (*b*), (*c*) and (*d*) are end views of four sizes of curves.

FIG. 4 is a front view of a speed control and an electric clipper supported on the belt of an operator.

FIG. 5 is an end view of a curve. A partial dashed lines illustration of electric clippers and blades indicates cutting both on concave and convex faces of the curve.

FIG. 6 is a view of the back of a person's head displaying clocked numbers for purpose of hair cutting instructions.

FIGS. 7(*a*), (*b*), (*c*) and (*d*) are perspective views showing cutting of hair on back, side and top.

FIG. 8 is a perspective view showing cutting of the bottom of the back of long hair.

FIGS. 9(*a*), (*b*) and (*c*) are sequential perspective views showing steps in the cutting of hair on the top of a person's head.

FIG. 10 is a perspective view showing the operation of feathering hair with a clipper.

FIGS. 11(*a*) and (*b*) are perspective views of two sizes of clipper blades.

FIGS. 12(*a*), (*b*), (*c*) and (*d*) are side, top and back views of the steps of giving a long layered cut. Some clocking numbers are displayed in the various views.

FIGS. 13(*a*), (*b*), (*c*) and (*d*) are side, top and back views of the steps of giving a short cut. Some clocking numbers are displayed in the various views.

FIGS. 14(*a*), (*b*), (*c*) and (*d*) are front, side and back views of the steps of giving a short layered cut. Some clocking numbers are displayed in the various views.

SPECIFIC DESCRIPTION

I will first describe the improvement in molded plastic toothed template curves that are used in cutting hair according to my improved method. In the first place, the curves 10 have the shapes of simple curves. Each curve has a backing portion 12 and has a multiplicity of paralle juxtaposed teeth 14, all the same length, extending from backing portion 12 on axes disposed at right angles to backing portion 12. The axis of backing portion 12 forms a simple curve (as distinguished from a complex curve) and comb 10 is arced preferably on a uniform radius relative to a centrally located axis 16 parallel to and spaced from the axes of teeth 14. Curves 10 preferably have a length of about nine inches along the curves. Making the curves much shorter would hamper operation for my purposes and I would consider a five inches length along the curves to be a very minimum curve length and to handicap easy operation even at that shorter length.

The fact that curves 10 are curved should not be confused with a thought of abutting the curvature of a person's head. My curves are not used to align the comb curvature to the curvature of a person's head. Some prior patentees have tried to facilitate hair cutting of mostly short men's hair by using a toothed template fitting like a band around a man's head to define the lower border of a man's haircut. Examples include: (a) A template for cutting men's hair, H. W. Babcock, U.S. Pat. No. 1,451,562, patented Apr. 10, 1923, in which a template had a complex curve parallel to the head to define the edge of the hair and had a semi-circular curve about the head. The Babcock toothed band theoretically could define the lower edge of a man's hairline, say for home cutting. However, the band would not be useful in other hair cutting because the teeth are not upwardly directed and could not raise the hair in position to be cut. (b) A template for cutting men's hair, Warner Post, U.S. Pat. No. 2,698,018, patented Dec. 28, 1954, rather similar to the Babcock template but making a complete band about the head. Like in the Babcock product, the teeth are downwardly directed and would not lift hair for cutting above the template lower edge. (c) An apparatus for cutting men's hair, R. G. Foley, U.S. Pat. No. 2,774,359, patented Dec. 18, 1956, in which a curved comb section is pivoted in an upright plane from an upright guide abutted to the head so that the hair may then be cut in a downwardly tapering or feathering pattern. (d) A template for home cutting of men's hair, V. D. Humphrey, U.S. Pat. No. 2,949,920, patented Aug. 23, 1960, in which the template has the form of a band buckled around the head, the template teeth being downwardly directed, inwardly bent and barbed "guiding the shears to insure the proper shingling of the hair". As the teeth are downwardly directed, they would not lift hair in position to be cut, i.e., a barber with a straight comb, in traditional barbering, directs the teeth of the hair upwardly to raise hair in position to be cut. (e) A comb for cutting men's or women's hair, R. M. Korst, U.S. Pat. No. 3,277,902, patented Oct. 11, 1966, in which the comb apparently is intended to conform to the shape of the head. The comb is a couple inches long and is used like a straight comb as a device abutted to the person's head to raise hair to be cut with clippers or shears on short straight lines. A comb handle prevents cutting on the reverse, concave comb side.

My curve instead is used primarily with the teeth directed perpendicular to the head or at abrupt angles when cutting near the head with hair of some length, i.e., women's hair. The concave side of the curve is directed either essentially downwardly or essentially upwardly (depending on whether hair is to be cut along the concave or convex side of the curve). When my curve is used, the hair has been treated with a sculpting foam that helps hold it in position. Opposed, adjacent, parallel surfaces 20 of teeth 14 are roughened to tend to hold the curve in position on the hair and to tend to grip the hair to hold it in position during cutting. Note that the last thing one would want with an ordinary comb is roughened opposed tooth surfaces—the ideal comb has as smooth opposed tooth surfaces as practical so that the comb will slide through the hair with minimum resistance.

The drawings show four curves 10 in FIGS. 3*a*, 3*b*, 3*c*, and 3*d* that differ as to the radiuses 22. Although a hair designer may not use the full set of four, a minimum of two curves of substantially different radiuses is needed. As will be understood from a later discussion, the curve 10 of smaller radius is used for greater reduction of weight of hair. Radiuses in prototypes from larger radiuses to samller radiuses were 4 23/32", 3⅞", 3¼" and 2 21/32".

Curves 10 are templates in the sense they define geodesic lines on which hair is to be cut to achieve various effects. To repeat a point previously made, curves 10 are not templates in the sense of abutting concave surfaces to user's heads but rather they are templates on which cuts are to be made on concave or convex faces to obtain desired hair effects. The geodesic effects are not directly great circle relationships to heads but instead the geodesic effects recognize that hair grows on an essentially spherical article of a certain general size. Change in radiuses of curves used do not relate to the size of the patient's head but rather whether more or less hair weight is to be removed-with the cut, a smaller radius removing greater hair weight.

The blade 24 of electric clipper 26 is brought along either the concave face or the convex face of curves 10. For freedom of movement of blade 24 along curves 10, it is best to provide a handle 30 for curves 10 so that the fingers will not have to directly hold curves 10 and get in the way of clipper blade 24. Handle 30 has a pair of prongs 32 secured to handle 30, by being embedded in one end of handle 30. Prongs are positioned by the operator in one of three pairs of openings 34 in each curve 10. The pairs of openings 34 include two end pairs and a central pair in each curve. Openings 34 are in the opposite side of curve backing portion 12 from teeth 14. Openings 34 can be directly in the material of curve 10 (which usually will be plastic) or may be in receptacles set in the plastic at the locations of openings 34. Which pair of openings 34 handle 30 is attached to depends on whether the cut with clipper 26 is on the concave or convex face of curve 10, where the hair is located, etc.

Clipper blade 24 is best guided along a face of curve 10 by riding along backing portion 12 rather than the irregular face of teeth 14, so each curve 10 is formed with a pair of first guiding surfaces 36 on each face extending from end to end of the curve and parallel to the face of teeth but spaced therefrom, i.e., perhaps 1/16". Whereas clipper blade 24 can be manually guided along backing portion 12, it is more convenient to have a second pair of second guiding surfaces 38 bordering each first guiding surface 36, extending outwardly perhaps 1/16" substantially perpendicular to first guiding surfaces 36, on the opposite side of backing portion 12 from teeth 14, to guide blade 26 along the length of each curve 10.

Curves 10 act like combs in the sense that hair may be lifted in position to be cut. Instead hair may be manually raised and curves 10 may be used to hold the hair in position. In either case, curves 10 are always used to define curved paths for travel of blade 24 of clipper 26. The straight combs used by hair cutters in the past were used to define short straight paths often for shears instead of long curved paths for clippers. The straight combs were used generally flat relative to the head whereas my curves 10 are more likely to be directed at abrupt angles relative to the head.

The illustration of FIGS. 11*a* and 11*b* show that a number of interchangeable blades 24 are used with my clipper 26. Preferably the sizes of blades provided are (a) #000, (b) #7, (c) #4.

The blade #000 is the one used most frequently. Clipper 26 is run full speed with blade #000 and this blade cuts the cleanest curve of the hair. It usually will be held upside down for notching of hair.

Whereas blade #000 is commonly used in cutting human hair, blades #7 and #4 have been used in the past only in cutting animal hair. The teeth are relatively coarse, i.e., less teeth per inch. Note that the blade 24 in FIG. 11*b* has less teeth per inch than the blade 24 in FIG. 11*a*. Whereas blades #7 and #4 can be used at full speed, of clipper 26, they are often used at part speed. This is the first time to my knowledge that partial speed has been used on clippers. The speed control 40 will be discussed later. I intend, however, that blade #000 will be used at full speed. Blades #4 and #7 are particularly valuable for texturizing of hair.

Blade #7 can be used at full or part speed depending on the cutting operation involved but usually will be used at part speed. It can be used on the scalp at the nape area. A rocking motion is suggested rather than just a unidirectional cut. A hair designer may find this blade to be particularly interesting on finer, silkier hair. The blade can be used freehand for feathering and texturizing of hair.

Blade #4 can be used much like blade #7. It can be used at full or part speed depending on the cutting operation but usually will be used at partial speed. It gives the softest design curve, using a hedging technique. This blade takes well to thicker, more coarse hair.

The size of blade wouldn't have made much difference in hair cutting if a speed control were not used, i.e., in most operations it is only when the clippers are slowed down with speed control 40 (reducing the rpm of clipper 26 as much as half or more) that a real difference is seen in using a #4 or #7 blade instead of a #000 blade. The #4 blade will hedge hair ½" if the blade is directed at the ends of the hair or ¼" if the blade is used flat. The #7 blade will reduce these hedging dimensions about half.

Clipper 26 is supported on a hook 44 on a belt 42 when both hands are needed to handle the hair and/or curve 10. The clipper motor may remain running. When practical, it is better because of the time saved to hold clipper 26 in the back of the space between thumb and forefinger, while still using the thumb and forefinger in manipulating the hair and a curve 10, rather than to hang the clipper on the belt. Supporting clipper 26 on the belt means clipper 26 does not need to be supported on a counter where it may be pulled off and broken. The use of belt 42 to support clipper 26 does mean both hands are fully available when needed.

Speed control 40 is also supported on belt 42. An especially flexible eight foot extension cord may be added to the length of the normal cord to speed control 40 so that the operator is given plenty of slack for moving around. The speed control 40 will provide for grounding with a three-prong plug and any extension cord also should have three conduits for grounding of speed control 40. A knob 46 on speed control provides for adjustment of speed of the motor of clipper 26.

A 5 amp speed control is suitable. The speed control is basically a variable transformer. I have used a speed control called "SPEEDIAL" manufactured by Lutron on Coopersburg, Pa., Model MK-11. The product was designed for use with such products as electric drills, sabre saws, sanders, home mixers, blenders etc.

For most hair cutting operations, hair should be treated with sculpting foam for the following purposes: (a) to provide better body for the hair (so that the hair will better maintain position to be cut), (b) so that the hair will tend to stick better to curves 10, and (c) to lubricate and cool blade 24. A suitable product I have used is called "Paul Mitchell Sculpting Foam with conditioners", sold in a pressurized can. Ingredients include: Water, Isobutane, Quaternium-23, Propane, Keratin Protein, Cetyl Alcohol, Cetrimonium Bromide, Amphoteric-4, Aloe Vera, Lanolin, Kelp, Polysorbate 20, DL-Panthenol (Vitamin $B_5$), Chamomile, Rosemary, Spearmint, Lecithin, Sassafras, Benzoic & Citric Acid, Methylparaben, Propylparaben, and FD & C Blue #1. This is distributed by Paul Mitchell Systems, PO Box 10597, Beverly Hills, CA. The product is somewhat like styling mousses but I would not recommend a regular mousse, i.e., a regular mousse does not cool and lubricate blade 24 satisfactorily. A typical mousse has the following ingredients: Water, Propylenglycol, Amphoteric-Surface, Acitive-Agents; Methylparaben, Polyvinyl-Pyrrolidone, and colors. Mousse, much less sculpting foam, is never used in cutting hair with shears. Commonly hair is wetted with water but not with mousse or foam which would make hair stick to fingers and shears.

In cutting with blade 24 against hair held in curve 10, it is best to give the end of blade 24 a little angle to tend to wedge the hair against backing portion 12 of curves 10. Hair can be said to be locked into a curve 10 so that it will not fall out of the curve particularly when the hair is depending from the curve, by rotating curve 10 as much as 180 degrees about an axis generally extending from end to end of curve 10.

Relative to manipulation of clipper 26, it may be noted that barbers invariably or nearly invariably move blades 24 up and down relative to a horizontal comb, never cross-wise, and always with the blade pointed up. In my method, we cut mostly cross-wise (along curve 10) and blade 24 usually is directed upside down. Up to a 9" cut is made. Frequently the cut will be about 5". It is physically impossible to "stairstep" hair when blade 24 is moved along curve 10.

FIG. 5 contrasts cutting on the inside (concave) face of curve 10 and cutting on the outside (convex) face of curve 10. Once the operator understands the effect on the hair of these two different cuts, then which face is used will be a function of the operator's design of the hair styling.

FIG. 6 shows the clock numbering of the head which may be used in instructions. The sides of the faces could be likewise similarly clocked.

In the FIG. 7(*a*) showing, the lower back is being cut. The upper portion is first pinned up out of the way with one curve 10. Then the lower ends of the hair are secured by another curve 10. The cut is made with blade 24 moving along the length of curve 10 on its lower convex face. This cut will produce a curved bottom to the back of the hair, whereas if the cut were made on the lower concave face of a curve 10, a straight bottom would be produced in the hair. The back would be finished by several similar cuts at successively higher locations on the back of the hair.

In the FIG. 7(*b*) showing, side bottom cut is being made on the convex face of curve 10, again producing a curved bottom line on the side of the hair. If instead the curve 10 were inverted in position and the bottom cut were on a concave face of curve 10, a straight bottom line would be produced in the hair. If curve 10 were upwardly tilted at its forward end, then, of course, the line of the bottom of the hair at the side of the face would be upwardly tilted at its forward end. Note that each time basically only one cut needs to be made to cut the bottom of the back of the hair in FIG. 7(*a*) or the bottom of the side of the hair in FIG. 7(*b*). Note that in FIGS. 7(*a*) and (*b*) blade 24 is directed in a manner which would be thought upside down in barbering. Looking at FIGS. 11(*a*) and (*b*) normally in barbering, the beveled surface 48 would be brought up parallel to and abutting the face of a straight comb. The beveled surface 48 would be the lower surface. However, in FIGS. 7(*a*) and 7(*b*) it is the point 50 of blade that contacts the underside of curve 10 and this could be considered upside-down from barbering practice. Of course the clipper 26 and blade 24 could be handled differently, more like in barbering, but the clipper manipulations depicted in the drawings are the easiest manners of handling clipper 26 and blade 24.

In FIGS. 7(*c*) and (*d*), portions of the hair on the upper portion of the head are being cut. In FIG. 7(*c*), the cut is made on the concave face of curve 10, which will remove more hair weight than the cut on the convex face of curve 10 shown in FIG. 7(*d*) which will leave more weight.

In FIG. 8, the lower edge of the hair at the back of the head is being cut in the same manner essentially as in FIG. 7(*a*), but with longer hair.

In styling hair with my new system sometimes it is desirable to rotate the hair perhaps 180°, perhaps 360°, perhaps 720°. This is illustrated in FIGS. 9(*a*), (*b*) and (*c*). In FIG. 9(*a*), the hair is secured by curve 10. In FIG. 9(*b*), the hair has been rotated a partial turn clockwise. Presuming it is desirable to rotate the hair more before cutting, the hair is rotated further clockwise to a full 360° in FIG. 9(*c*) before the cut is made with clipper 26 and blade 24. Depending on the design of the stylist, either the convex side of curve 10 could be directed upwardly as shown, or the concave side of curve 10 instead could be uppermost.

In FIG. 10, a process of feathering is illustrated. This can take two forms. In the illustration the hair is being held by curve 10 when blade 24 is used to feather the hair. A #7 or #4 blade is being used at a low speed that may be slow enough so that the reciprocating movement of the cutting parts in blade 24 can be seen. The clipper is rocked toward the hair and back from end to end of curve 10 thereby cutting only part of the hair due to the slow speed and the #7 or #4 blade. The other way to feather is to let the hair fall bit-by-bit against blade 24 as it is reciprocated parallel to the backing portion 12 of curve 10, again to cut only part of the hair.

FIGS. 12(*a*), (*b*), (*c*) and (*d*) illustrate cutting a long layered cut. In FIG. 12(*a*), center the curve 10 and engage the hair from the section 1 to 11, lift and turn the hair 90 degrees, and cut the entire top section (as seen in side view). Which size of curve 10 that is used and whether the cut is on the concave or the convex face of curve 10 is the designer's choice. FIG. 12(*b*) (in top view of the same step) illustrates rotating curve 10 360 degrees.

FIG. 12(*c*) illustrates relative to hair section 11 to 10, pivoting on 11 360 degrees, and cutting the inside of curve 10. The same step should be repeated on the opposite side as to hair section 1 to 2. FIG. 12 (*d*) deals with the back. This is cut in two sections. Curve 10 on the right side is centered and rotated clockwise 360 degrees and then cut (on the concave or convex side of a curve 10). The same thing is done on the left but the hair is rotated by the curve 10 counterclockwise 360 degrees before it is cut.

FIGS. 13(*a*), (*b*), (*c*) and (*d*) concern a short cut. In FIG. 13(*a*) the top section is illustrated. It is important to center curve 10 in the section. Hair section 11 to 1 should be lifted and turned 90 degrees and cut on the concave side of curve 10. The size of curve 10 is the designer's choice. Also illustrated in FIG. 13(*a*) is the side hair section 11 to 9. This hair side section should be pulled forward by a curve 10 and cut on the concave side of the curve. The other side would be cut likewise. Turning to FIG. 13(*b*), it is important to center curve 10 in the section. Hair section 11 to 1 is lifted to 12 and cut on the inside (concave side) of curve 10. Also illustrated in FIG. 13(*b*) is the side left section in which curve 10 should be centered in the section. Extend section 11 to 10, lift 9 to 11 90 degrees, and cut on the outside (convex side) of the curve. Repeat on the right side of the head. Referring to FIG. 13(*c*), the back should be started at section 6 and working 90 degrees to the head. The back should be worked horizontally in a succession of cuts to section 12. The cuts on curve 10 should be made on the convex face of a large curve. Referring to FIG. 13(*d*) and referring to the left side, a cut should be made 7 to 8 in which the cut is made on the concave side of curve 10. Then to cross-check the back, the curve 10 is positioned 9 to 6, 10 to 8, and 11 to 6, cutting across all sections on the convex side of the curve 10 thereby checking and correcting adjacent sections. The same procedure should be done on the right side.

FIGS. 14(*a*), (*b*), (*c*) and (*d*) show producing a short layered cut. In FIG. 14(*a*), lift and direct hair from 10 and 2 to 12 to the length desired. Then cut on the convex side of the size of curve 10 selected. In FIG. 14(*b*), lift and direct hair from 9 and 3 to 12. Cut on the convex side of the size of curve 10 selected. If shorter sides are desired around the ears, above the ears, and in the nape area, then cut on the concave side of curve 10 instead. Referring to FIG. 14(*c*), lift hair from 6 up in successive cuts as depicted. Cut to desired lengths. Cut on convex side of curve 10. The designer can select the size of curve 10. FIG. 14(*d*) concerns the back to side cut on the left side. A succession of cuts are made from 5 to 3 in which the cuts are matched to the back cuts. The cuts are made on the convex side of the size of curve 10 selected by the designer. The process is repeated on the right side.

Advantages of my new method of cutting hair and of my curve 10 include: reducing the time taken for an operator to cut hair yet achieving more precise results; more uniform and consistent results in cutting a head of hair, i.e., matching cutting in one location with another; permitting greater flexibility and creativity in cutting new designs but promoting more consistency in re-cutting and reproducing hair styles previously done on clients; and increasing the production of fullness and textures in hair because of the ease of producing these effects.

In describing the cutting operations in some of the steps in FIGS. 13 and 14, the hair is said to be rotated 90 degrees. By this is meant to rotate the curve 90 degrees about an axis extending from end to end of curve 10, so as to tend to lock the hair in place before cutting. Especially when cutting on the top of the head, hair may tend to fall out of curve 10 despite the roughened opposed surfaces on the teeth of curve 10 and despite the stickiness imparted by the sculpting foam, so rotating the comb 90 degrees about its longitudinal axis will tend to lock the hair in place until it can be cut. This 90 degree turn may be done in various cuts including some other cuts illustrated or mentioned in the drawings and description, i.e., the operations shown in FIG. 14(*b*), FIG. 7(*c*) and FIG. 7(*d*), especially if the operator has difficulty with the hair falling out of curve 10.

The twisting of the hair about an axis lateral to the comb, such as is illustrated in FIG. 9(*b*), FIG. 9(*c*), FIG. 12(*a*), FIG. 12(*b*) and FIG. 12(*d*), is for the purpose of achieving a novel layered cut in a circular pattern. This I have termed "circle cutting" and as far as I know I am the first to follow this procedure and to achieve this circular layered look.

Having thus described my invention, I do not wish to be understood as limiting myself for the exact construction shown and described. Instead, I wish to cover those modifications of my invention that will occur to those skilled in the art upon learning of my invention and which are within the proper scope thereof.

I claim:

1. A template curve for guiding hair shaping, comprising:

(a) a curve having a backing portion and having a multiplicity of parallel juxtaposed teeth extending from said backing portion on axes disposed at right angles to said backing portion, (b) said backing portion having a longitudinal axis and said longitudinal axis of said backing portion having simple curvature and said curvature being arced relative to a centrally located axis parallel to and spaced from said axes of said teeth, (c) adjacent teeth having roughened parallel surfaces facing each other to grip hair in order to retain the position of said teeth relative to hair engaged by said teeth, (d) said backing portion having on opposite sides thereof a first pair of generally parallel guiding surfaces spaced apart farther than the width of said teeth so that a clipper may be guided along said first pair of guiding surfaces on the convex or the concave face of said curvature to cut hair without contacting said teeth and said backing portion having on opposite sides thereof a second pair of guiding surfaces joining said first pair of guiding surfaces at generally right angles thereto and at the opposite margins of said first pair of guiding surfaces from said teeth so that a clipper may be guided along said second pair of guiding surfaces to generally maintain the same relative position of the clipper relative to said teeth and relative to hair being engaged by said teeth, and (e) said backing portion having a series of pairs of openings therein including end and central pairs of openings in the surface of said backing portion opposite to said teeth and a handle selectively positioned relative to said openings having a pair of prongs to be selectively, removably engaged in a pair of said openings, said handle being positioned by said prongs and openings generally in the plane of said curve.

2. The template curve of claim 1 in which there is a set of at least four curves differing as to the lengths of the radiuses of curvature of said arc of said backing portion.

3. The template curve of claim 2 in which the radiuses of curvatures are about 4 23/32", 3⅞", 3¼" and 2 21/32".

4. The template curve of claim 1 in which said curve is about nine inches long measured along said backing portion.

5. The template curve of claim 1 in which said curve is at least five inches long measured along said backing portion.

6. A template curve for guiding hair shaping, comprising:

(a) a curve having a backing portion and having a multiplicity of parallel juxtaposed teeth extending from said backing portion on axes disposed at right angles to said backing portion, (b) said backing portion having a longitudinal axis and said longitudinal axis of said backing portion having a simple curvature and said curvature being arced relative to a centrally located axis parallel to and spaced from said axes of said teeth, (c) adjacent teeth having roughened parallel surfaces facing each other to grip hair in order to retain the position of said teeth relative to hair engaged by said teeth, (d) said backing portion having on opposite sides thereof a first pair of generally parallel guiding surfaces spaced apart farther than the width of said teeth so that a clipper may be guided along said pair of first guiding surfaces on the convex or the concave face of said curvature to cut hair without contacting said teeth and said backing portion having on opposite sides thereof a second pair of guiding surfaces joining said first pair of guiding surfaces at generally right angles thereto and at the opposite margins of said first pair of guiding surfaces from said teeth so that a clipper may be guided along said second pair of guiding surfaces to generally maintain the same relative position of the clippers relative to said teeth and relative to hair being engaged by said teeth, and (e) there being a handle for said curve and securing means on said backing portion to secure said handle on the surface of said backing portion opposite to said teeth, said securing means being operative to selectively removably engage said handle at a central position or at either of two opposite end positions with the handle positioned in the plane of said curve.

7. A template curve for guiding hair shaping, comprising:

(a) a curve having a backing portion and having a multiplicity of parallel juxtaposed teeth extending from said backing portion on axes disposed at right angles to said backing portion, (b) said backing portion having a longitudinal axis and said longitudinal axis of said backing portion having a simple curvature and said curvature being arced relative to a centrally located axis parallel to and spaced from said axes of said teeth, (c) adjacent teeth having roughened parallel surfaces facing each other to grip hair in order to retain the position of said teeth relative to hair engaged by said teeth, and (d) said backing portion having on opposite sides thereof a first pair of generally parallel guiding surfaces spaced apart farther than the width of said teeth so a clipper may be guided along said first pair of guiding surfaces on the convex or the concave face of said curvature to cut hair without contacting said teeth and said backing portion having on opposite sides thereof a second pair of guiding surfaces joining said first pair of guiding surfaces at generally right angles thereto and at the opposite margins of said first pair of guiding surfaces from said teeth so that a clipper may be guided along said second pair of guiding surfaces to generally maintain the same relative position of the clippers relative to said teeth and relative to hair being engaged by said teeth.

8. A template curve for guiding hair shaping, comprising:

(a) a curve having a backing portion and having a multiplicity of parallel juxtaposed teeth extending from said backing portion on axes disposed at right angles to said backing portion, (b) said backing portion having a longitudinal axis and said longitudinal axis of said backing portion having a simple curvature and said curvature being arced relative to a centrally located axis parallel to and spaced from said axes of said teeth, (c) adjacent teeth having roughened parallel surfaces facing each other to grip hair in order to retain the position of said teeth relative to hair engaged by said teeth, and (d) said backing portion having a series of pairs of openings therein including end and central pairs of openings in the surface of said backing portion opposite to said teeth and a handle selectively positioned relative to said openings having a pair of prongs to be selectively, removably engaged in a pair of said openings, said handle being positioned by said prongs and openings generally in the plane of said curve.

9. The method of hair cutting, comprising:

engaging the hair of persons with a toothed curve having a convex face and a concave face and supporting the curve so that the curve becomes a template at a substantially fixed location during a cutting operation on the hair determining the length of the cut hair and determining the shape of the cut on the hair during each cutting operation, shaping the curve with a simple curvature arced relative to a centrally located axis parallel to and spaced from the axes of the teeth of the curve, cutting the hair by bringing an electric clipper having a blade along the curve and using the curve back opposite the teeth as a guide that the clipper moves along, and repeating the above step at various locations on the hair of each person, and applying said clipper sometimes to said convex face of said curve and other times to said concave face of said curve and with said curve in various positions including positions spaced from a person's head and including positions in which said curve is non-parallel to a person's head.

10. In the method of claim 9, using at least two separate, independent curves, unattached to each other, on the hair of a person for different cuts with the hair extending laterally of the adjacent faces of said curves, one curve being arced on a substantially lesser radius than a second curve to remove more weight of hair in a cut than with the second curve.

11. In the method of claim 9, using the clipper with said blade in inverted position during cutting of hair.

12. In the method of claim 9, changing said blade of the clipper during the cutting of the hair of a person as to the number of teeth on the blade per inch and changing the speed of the clipper during the cutting of the hair of a person.

13. In the method of claim 9, changing said blade of the clipper during the cutting of the hair of a person as to the number of teeth on the blade per inch.

14. In the method of claim 13, changing said blade among the sizes #000, #4, and #7.

15. In the method of claim 14, reducing the speed of the clipper during the cutting of hair of a person with blade sizes #4 and #7.

16. In the method of claim 9, changing the speed of the clipper during the cutting of hair of a person.

17. In the method of claim 9, cutting the bottom of the back of the hair of a person on said concave face of the curve to produce a generally horizontal lower edge to the hair.

18. In the method of claim 9, cutting the bottom of the back of the hair of a person on said convex face of the curve to produce a rounded lower edge to the hair.

19. In the method of claim 9, cutting the bottoms of the sides of the hair of a person on the convex face of the curve to produce a rounded lower edge to the hair.

20. In the method of claim 9, twisting the hair on the upper portion of a person's head at least 180 degrees before cutting.

21. In the method of claim 9, twisting the hair on the upper portion of a person's head at least 360 degrees before cutting.

22. In the method of claim 9, twisting an upper portion of the hair on the one side of a person's head at least 360° in a clockwise direction before cutting and twisting an upper portion of the hair on the other side of the person's head at least 360° in a counterclockwise direction before cutting.

23. In the method of claim 9, the step of feathering hair to remove interior weight structure of hair by reducing speed of said clipper and by substituting a clipper blade with larger teeth and by supporting hair on said curve while letting the hair gradually fall against said clipper which is being manually reciprocated whereby said clipper variously reduces the lengths of strands of hair.

24. In the method of claim 9, treating the hair before cutting with a sculpting foam giving the hair body to tend to maintain form during cutting operations, making the hair sticky so that the hair will tend to stick to the teeth of the curve during cutting operations, and lubricating and cooling the blade of the cutter.

25. In the method of claim 9, providing a speed control for said clipper and providing a belt for the hair designer and supporting said speed control on said belt and providing a hook on said belt and hanging said clipper on said hook on said belt at some times when said clipper is not in use during the cutting of the hair of a person.

26. In the method of claim 9, providing a curve with a length of about nine inches along the curvature of said curve.

27. In the method of claim 9, providing a curve with a length at least five inches along the curvature of said curve.

28. A template curve for guiding hair shaping, comprising:

(a) a curve having a backing portion and having a multiplicity of parallel juxtaposed teeth all of the same length extending from said backing portion on axes disposed at right angles to said backing portion, (b) said backing portion having a longitudinal axis and said longitudinal axis of said backing portion having a simple curvature and said curvature being arced relative to a centrally located axis parallel to and spaced from said axes of said teeth, (c) said backing portion having on opposite sides thereof a first pair of generally parallel guiding surfaces spaced apart farther than the width of said teeth so a clipper may be guided along said first pair of guiding surfaces on the convex or the concave face of said curvature to cut hair without contacting said teeth and said backing portion having on opposite sides thereof a second pair of guiding surfaces joining said first pair of guiding surfaces at generally right angles thereto and at the opposite margins of said first pair of guiding surfaces from said teeth so that a clipper may be guided along said second pair of guiding surfaces to generally maintain the same relative position of the clippers relative to said teeth and relative to hair being engaged by said teeth.

* * * * *